US008354627B2

(12) United States Patent
Martin

(10) Patent No.: US 8,354,627 B2
(45) Date of Patent: Jan. 15, 2013

(54) TORSION STOP DEPLOYMENT SYSTEM FOR AIRBORNE OBJECT

(75) Inventor: Robert W. Martin, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 756 days.

(21) Appl. No.: 12/579,970

(22) Filed: Oct. 15, 2009

(65) Prior Publication Data

US 2012/0228430 A1 Sep. 13, 2012

(51) Int. Cl.
*F42B 10/14* (2006.01)

(52) U.S. Cl. ..... 244/3.27

(58) Field of Classification Search ..... 244/3.29, 244/3.28, 3.27, 3.24, 138 A, 49
See application file for complete search history.

(56) References Cited

U.S. PATENT DOCUMENTS 4,460,137 A 7/1984 Andersson et al.
4,498,647 A * 2/1985 Boehringer et al. ..... 244/99.3
4,659,038 A 4/1987 Hoeppner et al.
4,817,891 A 4/1989 Gaywood
2007/0102567 A1 5/2007 Lee et al.
2008/0078859 A1 4/2008 Turner

OTHER PUBLICATIONS

European Patent Office, International Searching Authority, "International Search Report" mailed Apr. 4, 2011; International Appln. No. PCT/US2010/038508, filed Jan. 14, 2010.

* cited by examiner

*Primary Examiner* — Rob Swiatek
*Assistant Examiner* — Richard R Green
(74) *Attorney, Agent, or Firm* — Renner, Otto, Boiselle & Sklar, LLP

(57) ABSTRACT

Embodiments of a torsion stop deployment system for utilization onboard an airborne object are provided. In one embodiment, the torsion stop deployment system includes a deployable element hingedly coupled to the airborne object and rotatable from a non-deployed position to a deployed position. The torsion stop deployment system further includes a torsion bar member, which is fixedly coupled to the airborne object and which resiliently resists the rotation of the deployable element to reduce shock to the airborne object during deployment of the deployable element.

20 Claims, 3 Drawing Sheets

TORSION STOP DEPLOYMENT SYSTEM FOR AIRBORNE OBJECT

TECHNICAL FIELD

The present invention relates generally to airborne deployment systems and, more particularly, to embodiments of a torsion stop deployment system for use in conjunction with an airborne object, such as a missile or other projectile.

BACKGROUND

Missiles are commonly equipped with deployable flight control surfaces that provide aerodynamic guidance during flight. More recently, smaller projectiles (e.g., artillery shells) and modular components adapted to be mounted to smaller projectiles (e.g., fuse guidance kits) have also been equipped with deployable flight control surfaces. The deployable flight control surfaces often assume the form of a plurality of fins hingedly mounted to the projectile body. Each fin is rotatable between a non-deployed position, in which the fin resides against or within the projectile body, and a deployed position, in which the fin extends radially outward from the projectile body. Each fin is biased toward the deployed position by a mechanical biasing means (commonly referred to as a "deploy energy assembly") and/or by centrifugal forces acting on the projectile as it spins during flight. In many cases, an onboard restraint system prevents the fins from rotating into the deployed position until the desired time of deployment, which may occur shortly after projectile launch or firing. Alternatively, the walls of a storage container may prevent the fins from rotating into the deployed position until the projectile is removed from the container. After the fins are released from the non-deployed position, the fins rotate toward the deployed position and are secured therein by an onboard locking mechanism. By initially maintaining the fins in a non-deployed position, the fins are protected from physical damage that might otherwise in the course of soldier handling. In addition, initial fin stowage allows denser packaging of airframes.

It is typically desirable for fin deployment to occur in an extremely abbreviated time frame; e.g., on the order of a few fractions of a second. Thus, to achieve rapid fin deployment, deploy energy assemblies conventionally utilize one or more springs that store a significant amount of potential energy in their deformed state and that rapidly accelerate each fin from the non-deployed position through the deployed position. While enabling rapid fin deployment, conventional deployment systems that rapidly accelerate the fin through the deployed position can be disadvantageous for two primary reasons. First, onboard locking mechanisms of the type described above typically rely on precision alignment between mating components, such as spring-loaded pins, to secure the fin in the deployed position. When the rotational speed of the fin through the deployed position is excessively high, the onboard locking mechanism may have difficulty engaging the rapidly-rotating fin, which may then rotate past the desired deployed position. Fin over-rotation impacts the desired aerodynamic effects of the flight control surface and typically cannot be corrected by conventional deploy energy assemblies, which provide a unidirectional bias through the deployed position. As a second disadvantage, when the rapidly-rotating fin is abruptly arrested in the deployed position by the onboard locking mechanism, a significant mechanical shock or disturbance is produced and emanates through the projectile. Such a mechanical shock can potentially damage auxiliary components onboard the projectile and/or introduce inaccuracies into projectile guidance.

There thus exists an ongoing need to provide embodiments of a deployment system suitable for utilization with projectiles (or other airborne object) that enables rapid deployment of flight control surfaces (or other deployable elements) while overcoming the above-noted limitations associated with conventional deployment systems. In particular, it would be desirable to provide embodiments of a deployment system that reliably locks flight control surfaces in a precise position during rapid deployment, that returns the flight control surfaces to the deployed position should over-rotation occur, and that minimizes disturbances generated when the flight control surfaces are secured in the deployed position. Other desirable features and characteristics of the present invention will become apparent from the subsequent Detailed Description and the appended Claims, taken in conjunction with the accompanying Drawings and this Background.

BRIEF SUMMARY

Embodiments of a torsion stop deployment system for utilization onboard an airborne object are provided. In one embodiment, the torsion stop deployment system includes a deployable element hingedly coupled to the airborne object and rotatable from a non-deployed position to a deployed position. The torsion stop deployment system further includes a torsion bar member, which is fixedly coupled to the airborne object and which resiliently resists the rotation of the deployable element to reduce shock to the airborne object during deployment of the deployable element.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description.

Figure 1:
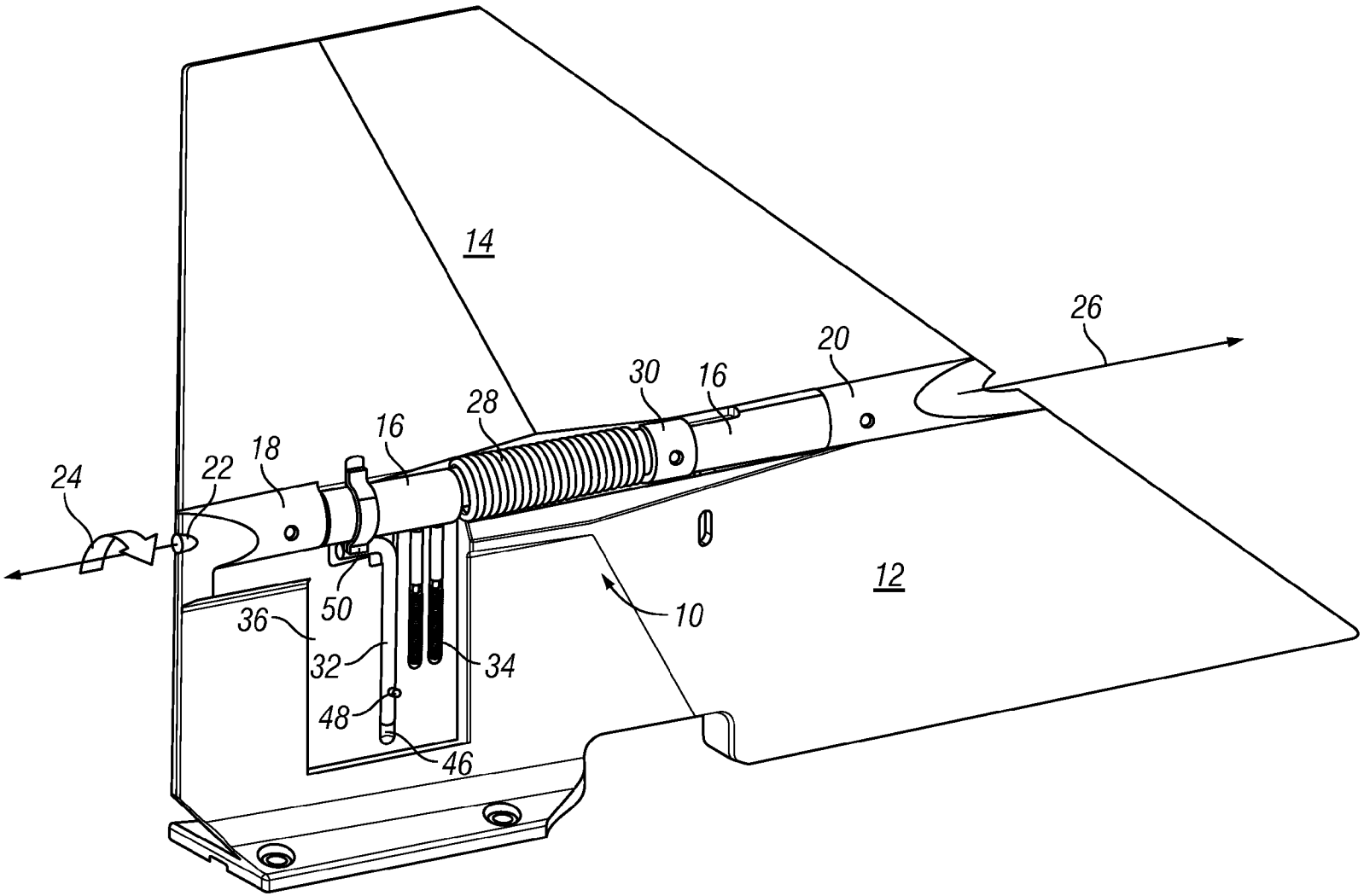
FIG. 1 is an isometric cutaway view of a torsion stop deployment system suitable for use onboard an airborne object in accordance with a first exemplary embodiment.

FIG. 1 is an isometric cutaway view of a torsion stop deployment system 10 in accordance with a first exemplary embodiment. Torsion stop deployment system 10 is well-suited for utilization onboard a projectile, such as a missile, an artillery shell, or other airborne munition. This notwithstanding, torsion stop deployment system 10 can be utilized in conjunction with various other types of airborne objects including airborne sub-munitions, modular components adapted to be mounted to airborne munitions (e.g., fuse and guidance kits), land- and water-based robotic vehicles, manned and unmanned aircraft, and satellite. Torsion stop deployment system 10 can be mounted to or otherwise integrated into the host airborne object in any suitable manner; for example, as indicated in FIG. 1, deployment system 10 can be partially or fully integrated into a mounting structure 12, which is, in turn, mounted to the body of an airborne object utilizing bolts or other such fasteners. Deployment system 10 includes at least one deployable element, which is rotatable between a stowed or non-deployed position and a deployed position. The deployable element preferably assumes the form of an aerodynamic flight control surface, such as a canard or fin of the type described below. However, the deployable element may assume various other forms including, but not limited to, that of an antenna, a solar collector, landing gear, and the like.

With reference to the exemplary embodiment illustrated in FIG. 1, torsion stop deployment system 10 further includes a deployable flight control surface, namely, a fin 14. Fin 14 includes a tubular barrel 16 (shown in partial cutaway in FIG. 1), which is positioned between first and second knuckles 18 and 20 provided on mounting structure 12. A hinge pin 22 (only the aft end portion of which can be seen in FIG. 1) extends through barrel 16 and through knuckles 18 and 20 to hingedly join fin 14 to mounting structure 12 and, therefore, to the host airborne object (not shown). As a result of this hinged coupling, and as indicated in FIG. 1 by arrow 24, fin 14 is able to rotate relative to mounting structure 12 and the host airborne object about a hinge line axis 26 (i.e., the longitudinal axis of hinge pin 22) from a non-deployed position to the deployed position illustrated in FIG. 1. In this particular example, hinge line axis 26 is substantially parallel to the longitudinal axis of the host airborne object (not show), and fin 14 resides substantially adjacent or "flat against" the body of the airborne object when fin 14 is in the non-deployed position; however, in alternative embodiments, hinge line axis 26 may be substantially orthogonal to the longitudinal axis of the host airborne object, and fin 14 may reside fully or partially within the body of the airborne object when in the non-deployed position.

Fin 14 is biased toward the deployed position by a deploy energy assembly. In the example shown in FIG. 1, the deploy energy assembly includes a torsion spring 28 and a mandrel 30 around which torsion spring 28 is wound. Torsion spring 28 and mandrel 30 are each disposed within the longitudinal bore of barrel 16 and extend between knuckles 18 and 20 of mounting structure 12. First and second arms of torsion spring 28 contact a component of fin 14 (e.g., an inner surface of barrel 16) and a component of mounting structure 12 (e.g., knuckle 18 or knuckle 20), respectively, to bias fin 14 toward the deployed position shown in FIG. 1. In alternative embodiments, the deploy energy assembly can include various other types of resilient elements (e.g., one or more spring packs of the type described below in conjunction with FIGS. 3 and 4). Furthermore, in certain embodiments, torsion stop deployment system 10 may not include an energy deploy system, and fin 14 may instead be biased toward the deployed position by centrifugal forces acting on the host airborne object during flight.

Figure 2:
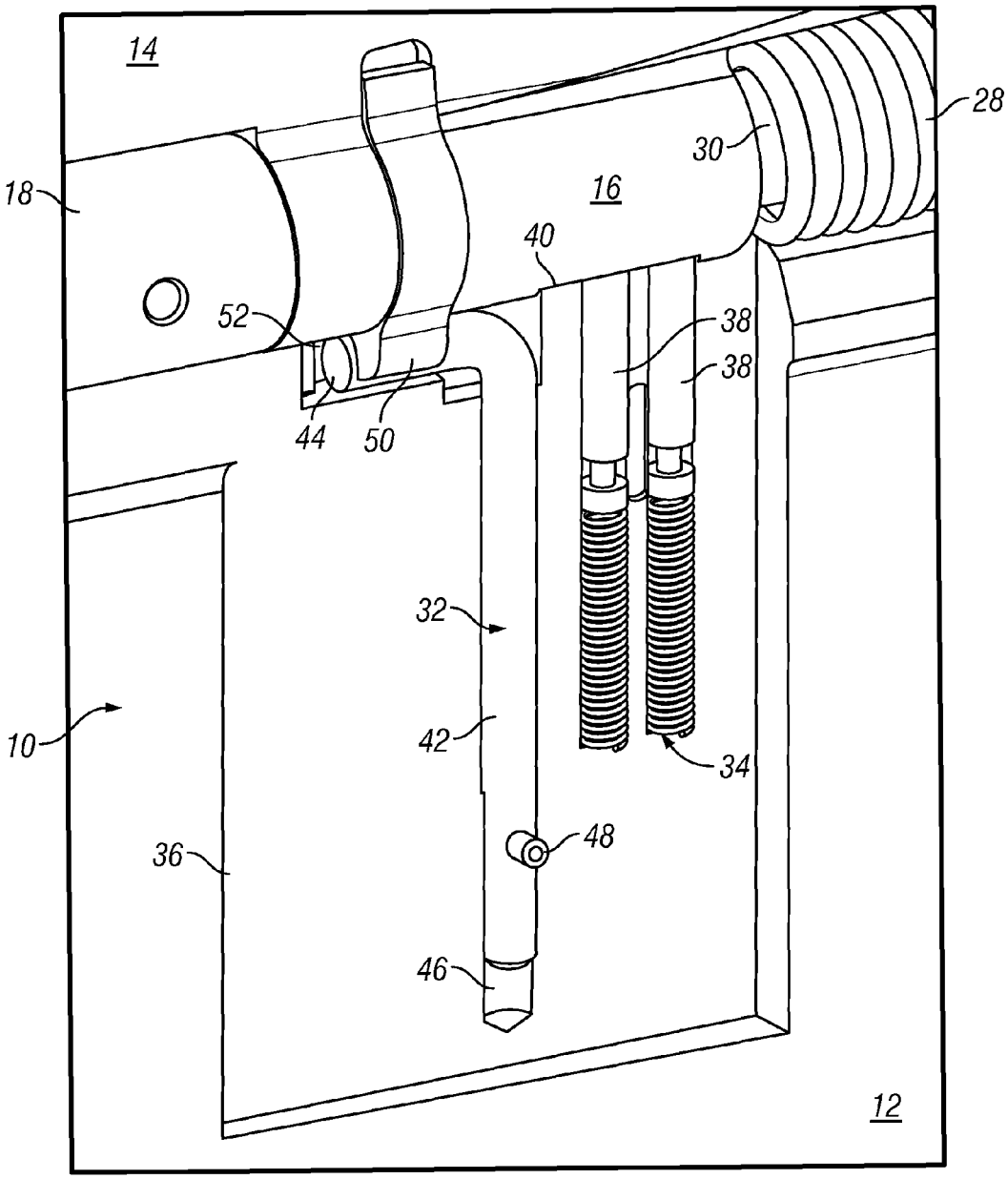
FIG. 2 is a more detailed isometric cutaway view of the torsion stop deployment system shown in FIG. 1.

FIG. 2 illustrates torsion stop deployment system 10 in greater detail. Referring collectively to FIGS. 1 and 2, torsion stop deployment system 10 further includes a precision locking mechanism 34, which is mounted within a cavity 36 provided within mounting structure 12. In this particular example, locking mechanism 34 assumes the form of twin spring-loaded pins 38 (identified in FIG. 2), which translate within corresponding cylindrical cavities provided within cavity 36. Spring-loaded pins 38 normally reside in a retracted position (not shown); however, when fin 14 rotates into the deployed position, an axial groove 40 provided in the outer surface of barrel 16 aligns with the heads of spring-loaded pins 38, and spring-loaded pins 38 extend into axial groove 40 to secure fin 14 in the desired deployed position as generally illustrated in FIGS. 1 and 2.

To minimize the duration of time required for fin 14 to deploy, it is desirable for torsion spring 28 to rapidly accelerate fin 14 upon release from the non-deployed position. At the same time, it is desirable for precision locking mechanism 34, which relies on a low tolerance alignment of mating features (i.e., spring-loaded pins 38 and axial groove 40), to engage fin 14 in a reliable manner and without generating significant mechanical shock. To satisfy these competing objectives, torsion stop deployment system 10 further includes a torsion bar member 32, which is mounted within cavity 36 proximate precision locking mechanism 34 and hinge line axis 26 (identified in FIG. 1). As shown most clearly in FIG. 2, the elongated body of torsion bar member 32, referred to herein as a "resilient twist beam 42," is mounted within a cylindrical recess 46 provided within cavity 36. A first end of resilient twist beam 42 is affixed to an inner wall of mounting structure 12 utilizing, for example, a pin 48. The opposing end of resilient twist beam 42 is fixedly coupled to the head of torsion bar member 32, which is referred to herein as a "torsion bar catch feature 44." In the exemplary embodiment illustrated in FIGS. 1 and 2, resilient twist beam 42 and torsion bar catch feature 44 are integrally formed as a curved or L-shaped torsion key; however, resilient twist beam 42 and torsion bar catch feature 44 can be formed as discrete pieces that are subsequently joined together in alternative embodiments.

Fin 14 further includes stop feature (i.e., a stop plate 50) affixed to barrel 16. As generally shown in FIG. 2, stop plate 50 engages torsion bar catch feature 44 when fin 14 rotates into the deployed position. After initially contacting torsion bar catch feature 44, stop plate 50 continues to rotate through catch feature 44 due to the momentum of fin 14 and, possibly, also due to the continued influence of torsion spring 28. To accommodate the over-travel of stop plate 50 and fin 14, torsion bar catch feature 44 rotates about the longitudinal axis of resilient twist beam 42 (into the page in the orientation illustrated in FIGS. 1 and 2), and twist beam 42 winds about its longitudinal axis in conjunction with the angular displacement of catch feature 44. To facilitate the winding or twisting deformation of torsion bar member 32, a clearance is provided at least partially around catch feature 44 (as indicated in FIG. 2 at 52) and at least partially around twist beam 42. By resiliently impeding the movement of stop plate 50, torsion bar member 32 decelerates the rotational movement of fin 14 through the deployed position. Torsion bar member 32 thus slows the rotational speed of fin 14 increasing the likelihood of engagement between precision locking mechanism 34 and axial groove 40 and minimizing the shock generated by engagement between locking mechanism 34 and axial groove 40. Furthermore, if initial engagement between locking mechanism 34 and axial groove 40 does not occur, and fin 14 is consequently permitted to rotate beyond the deployed position, torsion bar member 32 will quickly arrest the rotational movement of fin 14, reverse the rotational direction of fin 14, and ultimately return fin 14 to the desired deployed position. Notably, torsion bar member 32 will return fin 14 to the deployed position at a significantly lower rotational speed thus providing a second, more prolonged opportunity for locking mechanism 34 to engage axial groove 40. In this manner, stored energy is returned to torsion stop deploy system 10 thereby balancing residual deploy spring forces.

The foregoing has thus provided an exemplary torsion stop deployment system that utilizes a torsion bar member (e.g., torsion bar member 32) to decelerate the movement of a deployable element (e.g., fin 14) into a desired deployed position. Notably, in the above-described embodiment, torsion bar member 32 does not engage fin 14 until fin 14 approaches or rotates fully into the deployed position; as a result, torsion bar member 32 does not impede the acceleration of fin 14, and thus the rapid deployment of fin 14, in any significant manner. As a further advantage, torsion bar member 32 is highly tunable within certain ranges; that is, the characteristics (e.g., the material from which torsion bar member 32 is formed, the dimensions of torsion bar member 32, etc.) can be chosen to achieve a desired rate and range over which fin 14 is decelerated. In the above-described exemplary embodiment, the longitudinal axis of torsion bar member 32 (and, specifically, of resilient twist beam 42) is offset from and substantially orthogonal to hinge line axis 26 of fin 14 (FIG. 1). This example notwithstanding, the longitudinal axis of the torsion bar member may be substantially parallel with the hinge line axis in alternative embodiments. Indeed, in certain embodiments, the torsion bar member may serve as the hinge pin, and the longitudinal axis of the torsion bar member may consequentially be co-axial with the hinge line axis. To further emphasize this latter point, a second exemplary embodiment of a torsion stop deployment system including a torsion bar member that serves as the hinge pin is described below in conjunction with FIGS. 3 and 4.

Figure 3:
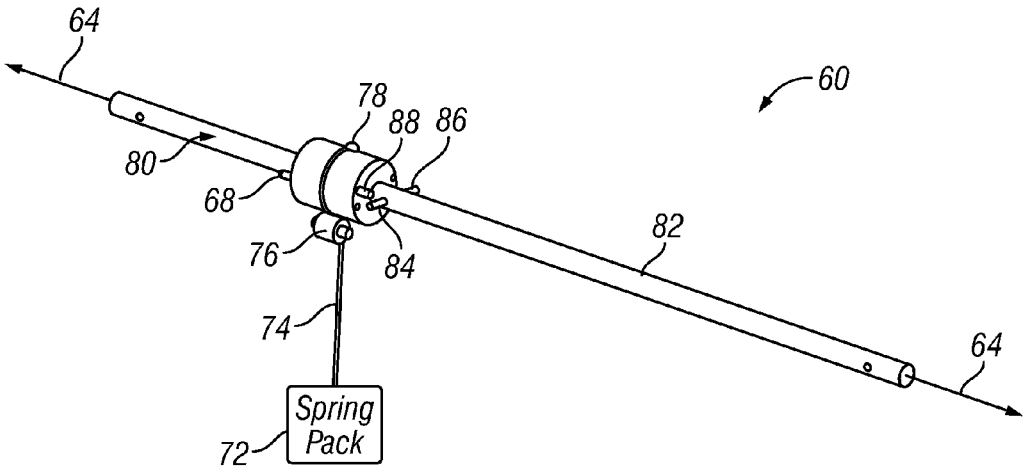
FIG. 3 is an isometric cutaway view of a torsion stop deployment system suitable for use onboard an airborne object in accordance with a second exemplary embodiment.
Figure 4:
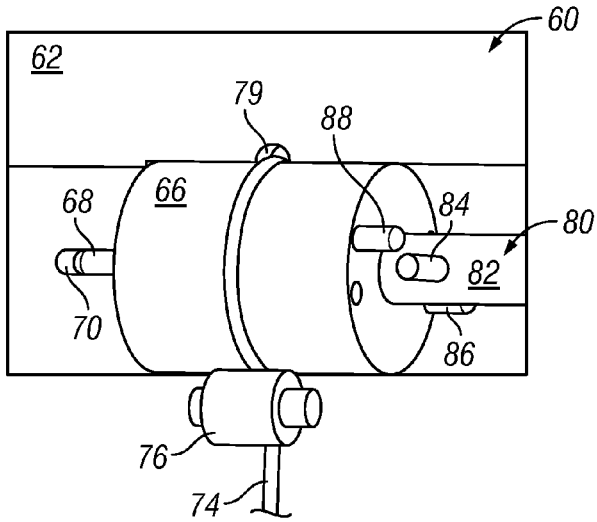
FIG. 4 is a more detailed isometric cutaway view of the torsion stop deployment system shown in FIG. 3.

FIG. 3 is an isometric cutaway view of a torsion stop deployment system 60 in accordance with a second exemplary embodiment, and FIG. 4 is an isometric cutaway view of deployment system 60 illustrating the core components of deployment system 60 in greater detail. In many regards, torsion stop deployment system 60 is similar to torsion stop deployment system 10 described above in conjunction with FIGS. 1 and 2. For example, torsion stop deployment system 60 includes a fin 62 (partially shown in FIG. 4), which may be hingedly coupled to a missile or other airborne object in the manner described above (e.g., via a mounting structure, such as mounting structure 12 shown in FIGS. 1 and 2). Fin 62 is rotatable about a hinge line axis 64 (FIG. 3) between a non-deployed and a deployed position. As was the case previously, fin 62 is biased toward the deployed position by a deploy energy assembly. In this case, the deploy energy assembly includes a spring pack 72 (shown generically in FIG. 3), which is mechanically connected to a rotatable body 66 via a cable 74 and pulley 76. Rotatable body 66 is, in turn, fixedly coupled to the main body of fin 62 utilizing, for example, one or more dowel pins 68 that extend from rotatable body 66 into mating slots 70 provided in fin 62. Cable 74 extends within an arcuate channel 79 provided within fin 62 around rotatable body 66, and the terminal end of cable 74 is attached to rotatable body 66 by way of a fastener 78 (FIG. 3). When fin 62 is in the non-deployed position, spring pack 72 urges the retraction of cable 74 to bias rotatable body 66, and more generally fin 14, toward the deployed position illustrated in FIG. 4. Although not shown in FIGS. 3 and 4 for clarity, torsion stop deployment system 60 further includes a precision locking mechanism (e.g., precision locking mechanism 34 shown in FIGS. 1 and 2) that secures fin 14 in the deployed position in the above described manner.

Torsion stop deployment system 60 further includes a torsion bar member 80, which extends through a longitudinal bore provided through rotatable body 66 and the terminal ends of which are fixedly mounted to the host airborne object (not shown in FIGS. 3 and 4 for clarity). Torsion bar member 80 is able to rotate relative to rotatable body 66 and, therefore, relative to fin 62. In this example, torsion bar member 80 also functions as a hinge pin; thus, the longitudinal axis of torsion bar member 32 is co-axial with the hinge line axis 64 (identified in FIG. 3). Torsion bar member 80 includes a resilient twist beam 82, a first torsion bar catch feature 84, and a second torsion bar catch feature (hidden from view in FIGS. 3 and 4). In this particular example, first torsion bar catch feature 84 assumes the form of a first catch pin, which extends radially outward from resilient twist beam 82 in a first direction. The second torsion bar catch feature (again, hidden from view in FIGS. 3 and 4) may likewise assume the form of a second catch pin, which extends radially outward from resilient twist beam 82 in a second, opposing direction. As fin 14 and rotatable body 66 rotate toward the deployed position (shown in FIG. 4), first torsion bar catch feature 84 is engaged by a first stop feature or pin 86 extending radially outward from rotatable body 66. Similarly, as fin 14 and rotatable body 66 rotate toward the deployed position (shown in FIG. 4), the second torsion bar catch feature is engaged by a second stop feature or pin 88 extending radially outward from rotatable body 66. After contact between the torsion bar catch features and the stop features of rotatable body 66 occurs, torsion bar member 80 resiliently resists the rotation of fin 62 into the deployed position to reduce shock to the host airborne object. More specifically, torsion bar member 80 slows the rotational movement of rotatable body 66, and therefore fin 14, near the deployed position to facilitate the locking of fin 14 in the deployed position and to minimize any shock created thereby. Furthermore, should fin 14 beyond the desired deployed position, torsion bar member 80 will return fin 14 to the deployed position and provide a second, more prolonged opportunity during which fin 14 can be locked in the deployed position.

It should thus be appreciated that there has been provided multiple exemplary embodiments of a torsion stop deployment system suitable for utilization onboard a projectile (or other airborne object) that enables rapid deployment of flight control surfaces (or other deployable element). Relative to conventional deployment systems, the above-described exemplary embodiments of the torsion stop deployment system reliably lock flight control surfaces in a desired deployed position during rapid deployment, return the flight control surfaces to the deployed position should over-rotation of the flight control surfaces occur, and minimize disturbances generated when the flight control surfaces are secured in the deployed position. While described above in conjunction with a particular type of airborne object (i.e., missiles and other projectiles) and a particular type of deployable element (i.e., aerodynamic fins), it is emphasized that embodiments of the torsion stop deployment system are equally applicable to various other types of airborne objects and deployable elements.

While multiple exemplary embodiments have been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A torsion stop deployment system for utilization onboard an airborne object, comprising:

a deployable fin hingedly coupled to the airborne object and rotatable from a non-deployed position to a deployed position; and a torsion bar member, comprising a resilient twist beam, fixedly coupled to the airborne object and configured to resiliently resist the rotation of the deployable fin to reduce shock to the airborne object during deployment of the deployable fin.

2. A torsion stop deployment system according to claim 1 wherein the torsion bar member further comprises a torsion bar catch feature; and wherein the resilient twist beam is fixedly coupled to the torsion bar catch feature.

3. A torsion stop deployment system according to claim 2 wherein a first end portion of the resilient twist beam is fixedly coupled to the airborne object.

4. A torsion stop deployment system according to claim 2 wherein the torsion bar member is configured to wind about the longitudinal axis of the resilient twist beam as the deployable fin rotates into the deployed position.

5. A torsion stop deployment system according to claim 4 wherein the torsion bar catch feature extends radially from the resilient twist beam.

6. A torsion stop deployment system according to claim 4 wherein the torsion bar catch feature and the resilient twist beam are integrally formed as a curved torsion key.

7. A torsion stop deployment system according to claim 2 further comprising a mounting structure having a cavity therein, the torsion bar member disposed in the cavity proximate the deployable fin.

8. A torsion stop deployment system according to claim 7 further comprising a locking mechanism disposed in the cavity proximate the torsion bar member, the locking mechanism configured to lock the deployable fin in the deployed position.

9. A torsion stop deployment system according to claim 8 wherein the locking mechanism comprises a spring-loaded pin, and wherein the deployable fin has an axial groove in a surface thereof, the spring-loaded pin configured to extend into the axial groove when the deployable fin rotates into the deployed position to secure the deployable fin therein.

10. A torsion stop deployment system according to claim 2 wherein the deployable fin is configured to rotate about a hinge line axis, and wherein the longitudinal axis of the resilient twist beam is substantially orthogonal to the hinge line axis.

11. A torsion stop deployment system according to claim 10 further comprising a stop plate fixedly coupled to the deployable fin and configured to rotate along therewith, the stop plate engaging the torsion bar catch feature as the deployable fin rotates into the deployed position.

12. A torsion stop deployment system according to claim 2 wherein the deployable fin is configured to rotate about a hinge line axis, and wherein the hinge line axis is substantially co-axial with the longitudinal axis of the torsion bar member.

13. A torsion stop deployment system according to claim 12 wherein the deployable fin comprises a rotatable body having a longitudinal bore through which the resilient twist beam extends.

14. A torsion stop deployment system according to claim 2 wherein the deployable fin comprises a flight control surface.

15. A torsion stop deployment system for utilization onboard an airborne object, comprising:

a deployable fin hingedly coupled to the airborne object and rotatable from a non-deployed position to a deployed position; and a torsion bar member, comprising:

a torsion bar catch feature positioned to engage the deployable fin as the deployable fin rotates toward the deployed position; and a resilient twist beam fixedly coupled between the torsion bar catch feature and the airborne object, the torsion bar member configured to wind about the longitudinal axis of the resilient twist beam to resist the rotation of the deployable fin when the torsion bar catch feature engages the deployable fin.

16. A torsion stop deployment system according to claim 15 wherein the deployable fin comprises a stop feature configured to contact the torsion bar catch feature as the deployable fin rotates into the deployed position.

17. A torsion stop deployment system according to claim 16 wherein the deployable fin is rotatable about a hinge line axis, and wherein the longitudinal axis of the resilient twist beam is substantially orthogonal to the hinge line axis.

18. A torsion stop deployment system according to claim 16 wherein the resilient twist beam includes a first end portion and a second end portion, the first end portion fixedly mounted to the airborne object, and the second end portion fixedly coupled to the torsion bar catch feature.

19. A torsion stop deployment system for utilization onboard an airborne object, comprising:

a mounting structure configured to be mounted to the airborne object;

a fin hingedly coupled to the mounting structure and rotatable about a hinge line axis from a non-deployed position to a deployed position;

a deploy energy system coupled to the mounting structure and biasing the fin toward the deployed position;

a locking mechanism mounted to the mounting structure and configured to lock the fin in the deployed position; and a torsion bar member, comprising a resilient twist beam, mounted to the mounting structure and engaging the fin as the fin rotates from the non-deployed position to the deployed position to decelerate the fin as the fin rotates proximate the deployed position.

20. A torsion stop deployment system according to claim 19 wherein the resilient twist beam has a first end portion fixedly coupled to the mounting structure; and wherein the torsion bar member further comprises a torsion bar catch feature extending radially from the resilient twist beam, the torsion bar catch feature positioned to contact the fin as the fin rotates into the deployed position.

* * * * *